US007909479B2

(12) United States Patent
Rooymans

(10) Patent No.: US 7,909,479 B2
(45) Date of Patent: Mar. 22, 2011

(54) LIGHTING ARRANGEMENT AND SOLID-STATE LIGHT SOURCE

(75) Inventor: Johannus Otto Rooymans, Ermelo (NL)

(73) Assignee: Lemnis Lighting Patent Holding B.V., Naarden (NL)

( * ) Notice: Subject to any disclaimer, the term of this patent is extended or adjusted under 35 U.S.C. 154(b) by 261 days.

(21) Appl. No.: 11/920,576

(22) PCT Filed: Jun. 9, 2006

(86) PCT No.: PCT/NL2006/050135

§ 371 (c)(1),
(2), (4) Date: Nov. 16, 2007

(87) PCT Pub. No.: WO2006/132533

PCT Pub. Date: Dec. 14, 2006

(65) Prior Publication Data

US 2009/0175038 A1 Jul. 9, 2009

(30) Foreign Application Priority Data

Jun. 10, 2005 (NL) ..... 1029231
Sep. 14, 2005 (NL) ..... 1029955

(51) Int. Cl.
*F21V 9/00* (2006.01)

(52) U.S. Cl. ..... 362/231; 362/153; 362/230

(58) Field of Classification Search ..... 362/227, 362/230, 231, 800, 545
See application file for complete search history.

(56) References Cited

U.S. PATENT DOCUMENTS

2003/0063462 A1* 4/2003 Shimizu et al. ..... 362/230
2004/0239243 A1* 12/2004 Roberts et al. ..... 313/512
2005/0002191 A1* 1/2005 Shimizu et al. ..... 362/237
2007/0291473 A1* 12/2007 Traynor ..... 362/106

* cited by examiner

*Primary Examiner* — Y My Quach Lee
(74) *Attorney, Agent, or Firm* — David P. Owen; Coraline J. Haitjema; Hoyng Monegier LLP

(57) ABSTRACT

The invention relates to a lighting arrangement for illuminating a surface. The lighting arrangement has a supporting element and a lighting unit (1) which is supported by the supporting element. The lighting unit (1) has a housing (2) which is designed to accommodate a solid-state light source (4). The housing is also transparent on at least one side. The solid-state light source (4) is suitable for generating light having wavelengths from a first wavelength region and a second wavelength region. The first wavelength region comprises wavelengths of 500-550 nm. The second wavelength region comprises wavelengths of 560-610 nm. The lighting unit (1) is designed to generate light having a dominant wavelength from the first wavelength region in such a way that the eye sensitivity of the human eye is dominated by rods.

20 Claims, 4 Drawing Sheets

LIGHTING ARRANGEMENT AND SOLID-STATE LIGHT SOURCE

Figure 1:
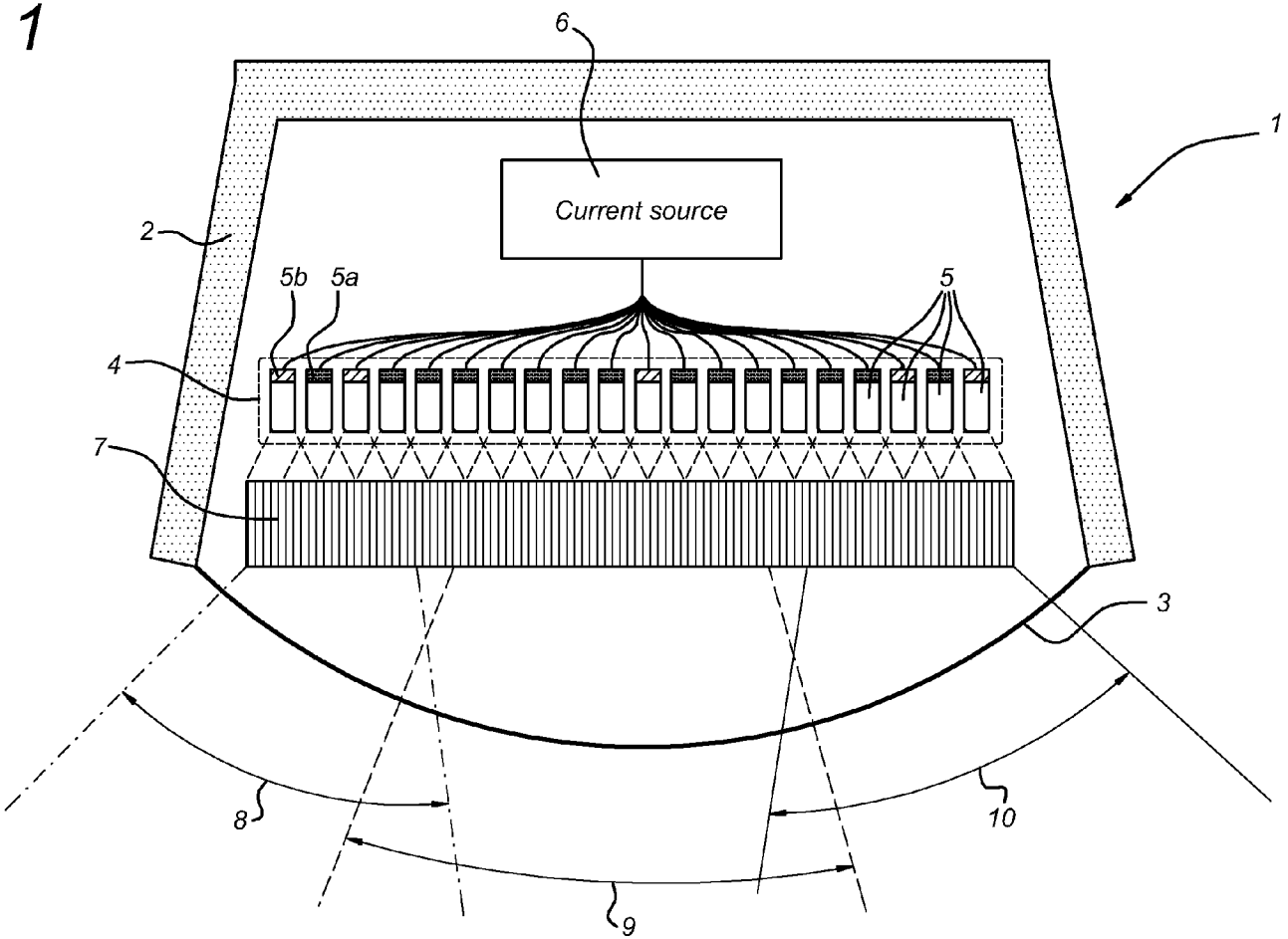

The invention relates to a lighting arrangement for illuminating a surface comprising:

a supporting element;

a lighting unit which is supported by the supporting element;

wherein the lighting unit comprises a housing which is designed to accommodate a solid-state light source suitable for generating light having wavelengths from a first wavelength region and a second wavelength region, the housing being transparent on at least one side.

A lighting arrangement of this type is known from American Patent Application US2004/0105264 and makes it possible for a public space to be illuminated in a highly efficient manner. In particular, a lighting arrangement of this type is suitable for use as street lighting. As also described in US2004/0105264, light beams emitted by street lighting generally have a colour which is between blue/white and yellow/orange. This affords adequate lighting having an agreeable aura. A drawback of street lighting having such a colour, however, is that the human eye in a darkened environment is not optimally accommodated for light having such a wavelength. The human eye comprises so-called cones and rods. The cones are active only above a sufficiently large light intensity. They are individually linked to the brains via a bundle of nerves and are additionally able to perceive colour. The rods, in contrast become much more active at low light intensity, are not able to detect colour and can link groupwise to the brains, as a result of which a perceived image based solely on rods has lower resolution than a perceived image based solely on cones. The cones are most sensitive for light having a wavelength of about 555 nm, i.e. yellowish light. At low light intensity, in contrast, as is the case for a completely darkened environment, the rods are active. These are most sensitive for light having a shorter wavelength, i.e. 507 nm.

The object of the present invention is to provide a lighting arrangement which, when used for night-time lighting of a public space such as a street, garden or car park, provides better observability of that public space to the human eye. The abovementioned lighting arrangement is therefore characterized in that the first wavelength region comprises wavelengths of 500-550 nm, the second wavelength region comprises wavelengths of 560-610 nm, and the lighting unit is designed to generate light having a dominant wavelength from the first wavelength region in such a way that the eye sensitivity of the human eye is dominated by rods.

As a result of light having a dominant wavelength of 550-550 nm, i.e. "green" light, being emitted use is made of the said enhanced sensitivity of the eye, the sensitivity of the rods even being 2.5 times greater than the sensitivity of the cones around 555 nm. Owing to a lack of spectral bandwidth, the sole use of wavelengths from the first wavelength region will make it very difficult or even impossible to perceive colour. This results in less contrast and reduced visibility of contours. To ensure that the enhanced sensitivity associated with "green" light, does not go hand in hand with loss of contrast and lacking colour perception, the solid-state light source is also suitable for generating light having wavelengths from the second wavelength region, the second wavelength region comprising wavelengths of 560-610 nm, thereby enabling good perception in a darkened environment, the presence of light having wavelengths from the second wavelength region also facilitating colour perception. The light perceived by the eyes, which comprises a combination of wavelengths from both wavelength regions, is therefore also experienced to be "friendlier" and "softer" than exclusively "green light".

In an embodiment, the lighting arrangement illuminates the surface to be illuminated with a light intensity of 5-30 lux. To make sure that the enhanced sensitivity of the human eye is not lost even in the first wavelength region owing to too high a degree of illumination of the environment, the design of the lighting unit is such that the surface to be illuminated is illuminated with a light intensity of 5-30 lux.

In an embodiment, the solid-state light source has a total minimum light output of 300 lumens. Such an output is sufficient for minimum street lighting requirements.

In an embodiment of the lighting arrangement according to the present invention, the lighting unit further comprises a light processing unit for processing the intensity and/or direction of light generated by the solid-state light source. This allows the lighting arrangement to be installed in as simple a manner as possible, irrespective of any constraining environment factors.

The solid-state light source may comprise a plurality of Light Emitting Diodes (LEDs), which preferably have a beam angle of 30-70°. To ensure that the luminance at the surface to be illuminated is as uniform as possible, the LEDs are preferably arranged in such a way that the light source in use emits light at an angle of at least 20° relative to that surface. By means of an angle of between 20-30°, in particular, an optimum ratio can be achieved between a horizontal and vertical light intensity.

The lighting unit can further comprise, in all the abovementioned embodiments, a supply which can be connected to the solid-state light source. Owing to the presence of the supply, the lighting arrangement is independent of the availability of an external electrical network.

In an embodiment, the solid-state light source of the lighting arrangement comprises a number of first LEDs for emitting light having a wavelength situated in the first wavelength region and a number of second LEDs for emitting light having a wavelength situated in the second wavelength region. Subdividing the light source into two groups of LEDs, each group being suitable for emitting light having a different wavelength, makes it possible for segments of the surface to be illuminated to be illuminated by means of different wavelength combinations tailored to local conditions.

Preferably, a light yield of the number of first LEDs is 3-5 times greater than a light yield of the number of second LEDs. It was found that at such a ratio optimum colour perception is achieved without this being at the expense of excessive loss of sensitivity of the eye for perception in the dark.

In an embodiment, the first wavelength region comprises wavelengths of 530-550 nm and the second wavelength region wavelengths of 560-590 nm. It turned out that by using light from these two wavelength regions optimal results with respect to contrast and color observation can be obtained.

In an embodiment, the dominant wavelength is 507 nm. At this wavelength the sensitivity of the rods in the human eye is at its maximum.

In an embodiment, the lighting unit comprises a further light processing unit which processes the light coming from the number of first LEDs and light coming from the number of second LEDs in manners which differ from one another.

In all the embodiments of the present invention, the lighting arrangement can further comprise a cover element which has an orifice and is positioned in such a way around the lighting unit that the orifice coincides with the transparent side of the housing of the lighting unit. The cover element can act as an additional means of protection.

The present invention further relates to a solid-state light source suitable for generating light having wavelengths situated in a first wavelength region and wavelengths situated in a second wavelength region, characterized in that the first wavelength region comprises wavelengths of 500-550 nm, the second wavelength region comprises wavelengths of 560-610 nm, and the solid-state light source (4) is designed to generate light having a dominant wavelength from the first wavelength region. In an embodiment thereof, the solid-state light source has a total minimum light output of 300 lumens. This level of output is sufficient to meet minimum street lighting requirements.

In all embodiments, the solid-state light source may comprise a number of first LEDs for generating light having a wavelength situated in the first wavelength region, and a number of second LEDs for generating light having a wavelength situated in the second wavelength region. Subdividing the light source into two groups of LEDs, each group being suitable for generating light having a different wavelength, makes it possible to generate light having controlled local variation of wavelength combinations.

Preferably, a light yield of the number of first LEDs is 3-5 times greater than a light yield of the number of second LEDs. It was found that at such a ratio optimum colour perception is achieved without this being at the expense of an excessive loss of sensitivity of the eye for perception in the dark.

At least one of the plurality of LEDs can further have a beam angle of 30-70°.

Figure 2A:
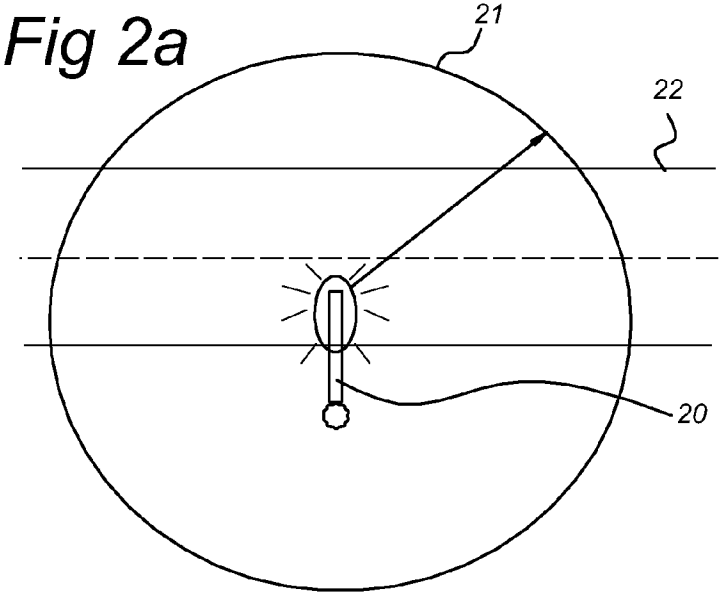
Figure 2B:
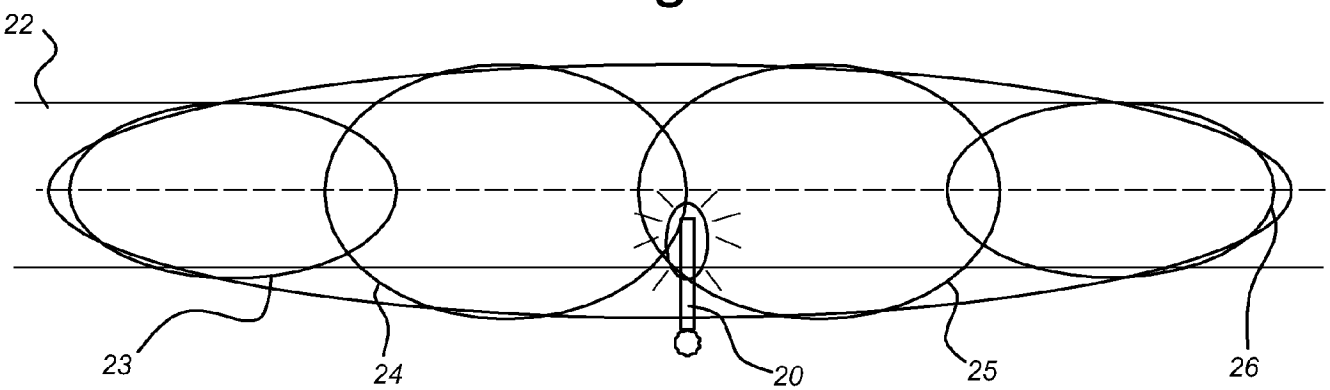
Figure 3:
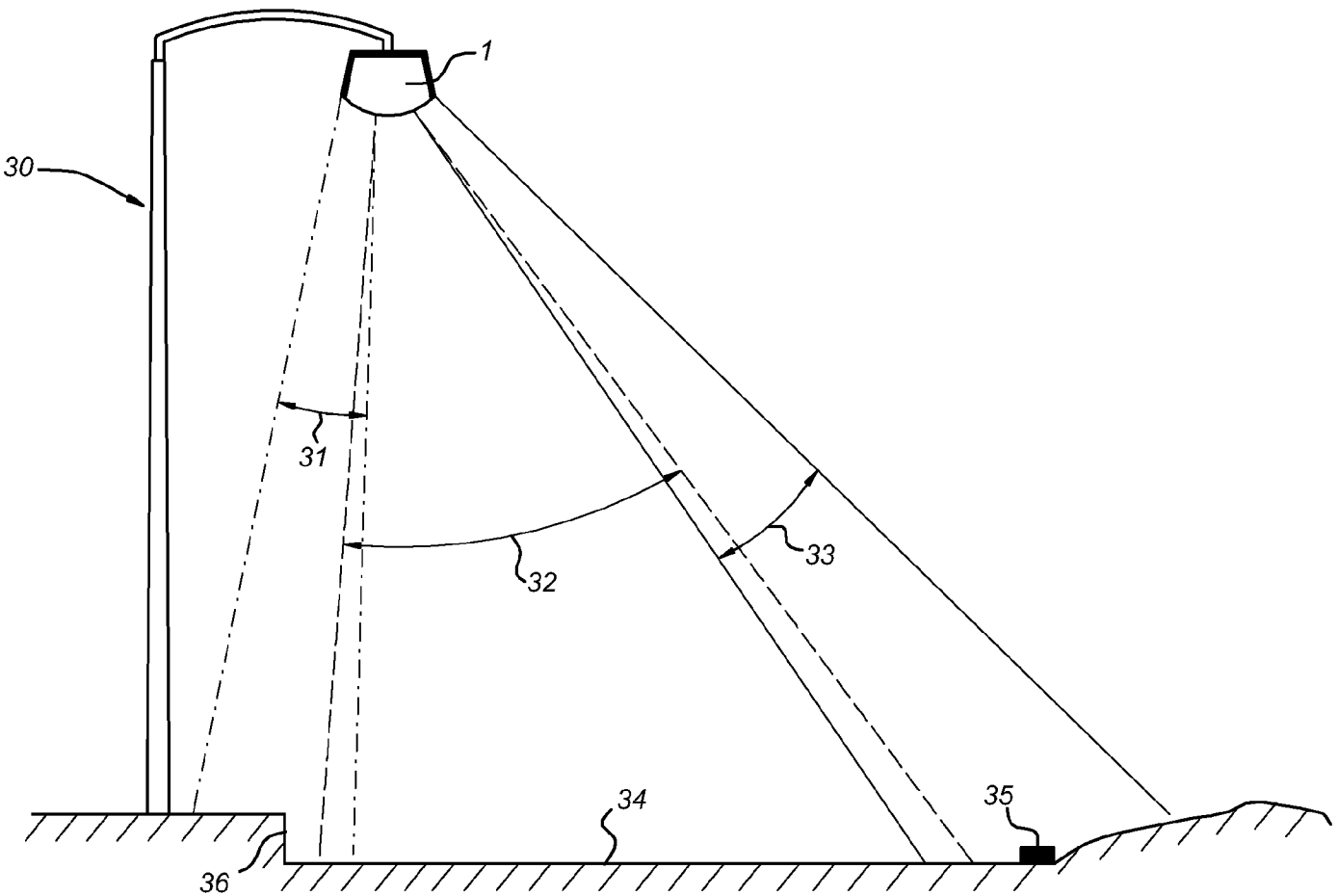
Figure 4A:
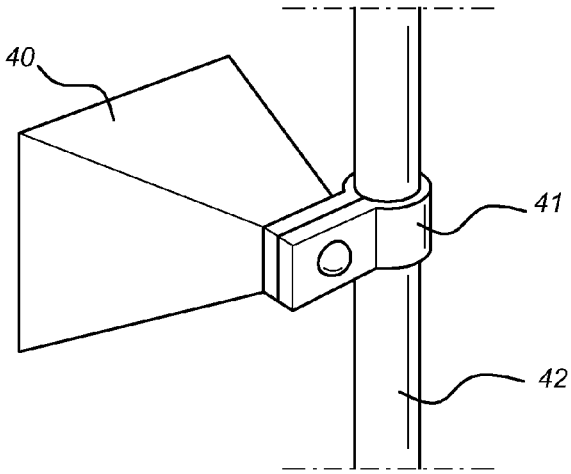
Figure 4B:
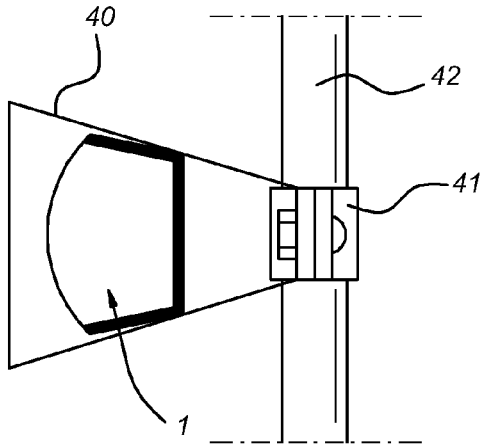
Figure 5:
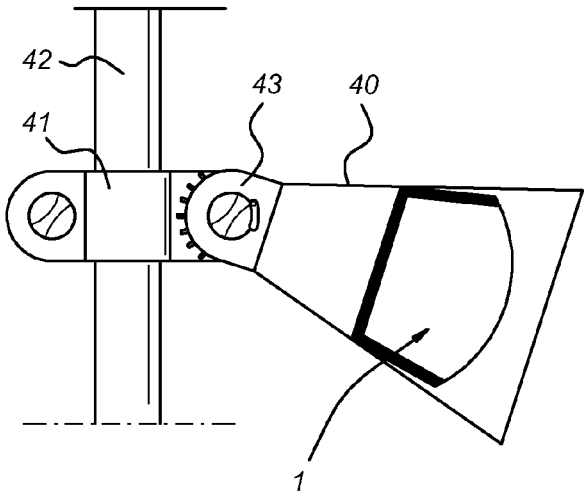

The present invention is explained below in more detail by way of example with reference to the following figures. The figures are not meant to limit the scope of the invention, but are solely intended for the illustration thereof. In the figures, FIG. 1 shows a lighting unit corresponding to an embodiment of the invention;

FIG. 2*a* schematically shows a top view of a lighting arrangement and the area illuminated by the lighting arrangement according to a first embodiment of the invention;

FIG. 2*b* schematically shows a top view of a lighting arrangement and the area illuminated by the lighting arrangement according to a second embodiment of the invention;

FIG. 3 schematically shows a side view of a lighting arrangement which illuminates a road surface according to an embodiment of the invention;

FIGS. 4*a* and 4*b*, respectively, show a top view and a cross section of a lighting arrangement according to another embodiment of the invention;

FIG. 5 schematically shows a side view of a cross section of a lighting arrangement according to yet another embodiment of the invention.

The present invention is discussed below with reference to an example relating to street lighting, but is not limited thereto. The invention can equally be used for night-time lighting of other spatial areas and/or objects such as gardens and car parks.

FIG. 1 shows a lighting unit 1 according to the present invention. The lighting unit 1, which is supported by a supporting element (not shown), comprises a housing 2 which is transparent on at least one side. In FIG. 1, this transparency is achieved by providing the housing 2 with a transparent element 3, but other alternatives, such as the housing being left open, a hole being provided in the housing on this at least one side, or other measures known to those skilled in the art are equally possible. The lighting unit 1 further comprises a solid-state light source 4, for example, as in FIG. 1, a plurality of Light Emitting Diodes (LEDs) 5. The light source 4 is connected to a supply, for example, as in FIG. 1, a current source 6. In FIG. 1 the supply is positioned in the housing, but it is equally possible for it to be located in the supporting element. In addition, the light source 4 can also be fed by an external supply situated outside the combination of supporting element and housing. Before emerging through the transparent side of the housing 2, the light generated by the light source 4 can, as shown in FIG. 1, pass a light processing unit 7. This light processing unit 7 makes it possible to process, for example, the intensity and/or the direction of the light generated by the light source 4.

A majority of the plurality of LEDs 5 is designed to emit light having a wavelength of between 500-550 nm. The precise wavelength depends on which semiconductor materials, such as InGaAs, have been used and to what extent these materials are doped. The emitted light of "green" LEDs 5*a*, indicated in FIG. 1 by a rectangle having an entirely black top, is within the range of extremely high sensitivity of the human eye under night-time conditions. However, because light having just one dominant wavelength is used, colour perception is virtually impossible. Therefore, the plurality of LEDs 5, in addition to "green" LEDs 5*a* preferably also comprises "amber" LEDs 5*b*, i.e. LEDs which generate light having a wavelength of 570-610 nm. In FIG. 1, "amber" LEDs 5*b* are indicated by a rectangle having a hatched top. When used as road lighting, the combination of "green" and "amber" LEDs 5*a*, 5*b* enables high-contrast vision, where relevant, coloured objects and symbols such as reflectors and coloured road markings are also visible. The "amber" LEDs 5*b* present as a minority in the light source 4 ensure reflection off, inter alia, yellow and red surfaces. In addition, the "amber" LEDs 5*b* soften the green character of the light.

It was found that a plurality of LEDs 5 comprising 3-5 times as many "green" LEDs 5*a* as "amber" LEDs 5*b*, assuming that each LED has virtually identical characteristics in terms of intensity and electrical rating, gives rise to optimum colour perception without excessive loss of the sensitivity of the eyes with respect to the perception in the dark. It must be understood that in the case of unequal characteristics of the "green" LEDs 5*a* and "amber" LEDs 5*b*, particularly in terms of light yield per LED, the abovementioned ratio of LEDs will be different specifically to cause the light yield of the "green" LEDs 5*a* to be 3-5 times that of the light yield of the "amber" LEDs 5*b*.

With the aid of the processing unit 7 it is possible, for example, as in FIG. 1, to cause the lighting unit 1 to emit light of different tinges, i.e. different wavelength compositions, in individual light beams 8, 9, 10 in various predetermined directions.

The light source 4 preferably has a light output of at least 300 lumens. This light output is sufficient to meet minimum street lighting requirements. It should be noted in this context that these requirements, which can vary considerably between types of road, are often linked to the amount of incident light per square metre of a surface. This so-called light intensity, normally expressed in lux, is a function not only of the light output of the light source 4, but is also inversely proportional to the square of the distance between the light source 4 and the surface to be illuminated. The normal mean light intensity of street lighting is 5 lux in small residential roads and country roads up to 20 lux on motorways and 30 lux at busy road junctions.

Light intensities expressed in lux are generally related to photometrically calibrated experimental values, 555 nm being used as the calibration point of a lux meter. On the basis of this calibration, the colour perception of the human eye is non-existent or very poor at a light intensity of less than 5 lux. However, as stated previously, the average human eye is 2.5 times more sensitive even in the dark at 507 nm than at 555 nm. A correct lux measurement of the light intensity in night-time conditions would therefore require calibration at 507 nm. The present invention makes use of the higher eye sensitivity in the specific night vision spectrum. It was found that in the case of a light source 4, designed to emit light in two separate wavelength regions, i.e. a first wavelength region of 500-550 nm and a second wavelength region of 560-610 nm, good perception of colour and contrast is achieved even at low intensity in lumens.

A simple embodiment of such a light source 4 comprises a plurality of LEDs comprising at least one "green" LED and at least one "amber" LED. Optimum results in terms of contrast and colour perception are found to be obtained if the first wavelength region covers a range of 500-530 nm and the second wavelength region covers a range of 560-590 nm. A possible explanation for this could be that light having a wavelength from the abovementioned wavelength region of 500-530 nm is optimal for the human eye in terms of night vision. In addition, the retina has its maximum sensitivity in the wavelength region of 560-590 nm.

Given combined perception of light having a wavelength from both the first and the second wavelength region, a person is capable of observing a wider range of colours than would be expected in terms of emitted wavelengths. This phenomenon is found to occur, in particular, if the wavelengths from the two regions are separated by more than 20 nm. Surprisingly, the use of a combination of a wavelength from both the first and the second wavelength region results in natural colour perception.

Using a solid-state light source 4, for example a plurality of LEDs 5, in applications such as road lighting, makes it possible, in contrast to e.g. sodium lamps, to achieve optimum light distribution on the road surface by means of lenses. An LED light source is a point source. A lighting arrangement 20 provided with a point source of this type will, if exit is possibly in only one direction, illuminate a circular symmetric area, as shown in FIG. 2*a*. With the aid of a processing unit 7, which for example comprises minuscule lenses, it is possible, however, to achieve any beam angle, thereby allowing the light to be directed to precisely the desired location. As known to those skilled in the art, minuscule lenses of this type can also be mounted on an LED itself. By means of precise positioning of the lens with respect to the light source of the LED it is therefore also possible to achieve a certain beam angle of an LED.

FIG. 2*b* shows a top view of a lighting arrangement 20 which, employing four LEDs/LED combinations illuminates four road sections. The road surface 22 is thus illuminated in the direction of traffic by means of so-called glancing light, causing the projected areas 23-26 of the four light beams to be elliptical. So as not to lose too much of the light yield, the beam angle of the LEDs is preferably in the range between 30° and 70°. In the abovementioned manner it is possible for the road surface to the illuminated over a larger area at an adequate light intensity, i.e. more than from 5 to 30 lux, without an increase in energy consumption. Illuminating the road surface at an angle moreover results in greater uniformity of the luminance.

If, however, the incident angle, i.e. the angle between the incident light and the surface to be irradiated (a road surface in the abovementioned example) drops below a critical incident angle, typically between 20° and 25°, there will be a drop in the perception efficiency. This is because the horizontal light intensity decreases and the vertical light intensity increases as the incident angle decreases. Consequently, in the event of the presence of objects such as cars on the surface to be illuminated, more pronounced shadowing with darker zones will occur, and horizontal elements such as road marks become less clearly visible. A negative effect of this type can be mitigated by equipping the light source 4 with a larger number of directional light sources having smaller output. These light sources can then be directed so as to illuminate the same area, at least in part, such as the overlapping elliptical projected areas in FIG. 2*b*.

Subdividing the light to be emitted into individual light beams enables different road sections to be illuminated with light comprising different combinations of wavelengths. To allow, for example, coloured road signage at the edge of a road to be readily discerned at night without any loss of optimum perception of contrast on the road itself, an orientation of light beams as shown in FIG. 3 is an option.

In FIG. 3, the lighting unit 1 of the lighting arrangement 30 produces three different, partially overlapping light beams 31, 32 and 33 each illuminating a different section of the road surface 34. Light beam 31 illuminates one side of the road surface 34 which is delimited by an abrupt rise 36 of the verge. Light beam 33 inter alia illuminates a road marking 35, for example a yellow strip or a red reflector installed on or in the road. Optimum perception of the road marking 35 and the abrupt rise 36 at night requires different optimization of the wavelength of the light striking the two objects. After all, optimization for perceiving the road markings 35 will be aimed primarily at an increase in the perceptibility of colour, whereas the perceptibility of the abrupt rise 36 is increased by wavelengths being incorporated in the light beam which increases the eye sensitivity at night-time conditions.

Light beam 32, finally, illuminates the centre of the road surface 34. As this beam 32 has to ensure adequately both the visibility of the road surface 34 and any vehicles that may be present thereon, as well as the visibility of reflectors and the like on these vehicles, optimization will have to take both aspects into account.

In an embodiment of the present invention, the light processing unit 7 and/or minuscule lenses mounted on the LEDs 5 ensure that each light beam 31-33 is generated by a different group of LEDs 5. The group of LEDs which is responsible for generating light beam 32 and comprises both "amber" and "green" LEDs is optimized for generating light suitable for adequate colour perception in conjunction with adequate eye sensitivity for perception at night. The optimum achieved corresponds to a particular ratio between the number of "amber" LEDs and the number of "green" LEDs. A reduction in the proportion of "amber" LEDs will increase eye sensitivity. While an increase in this proportion has an adverse effect thereon, it does promote colour perception. The proportion of "amber" LEDs in those groups of LEDs which are responsible for generating beams 31 and 33 is therefore lower and higher, respectively, than the number of "amber" LEDs responsible for generating beam 32.

Other options to achieve differentiation in wavelengths at various segments of road surface 34 are also possible. By limiting the beam angle of the light rays coming from the "amber" LEDs it is possible, for example, to cause edges of a road surface 34 to be illuminated with a wavelength more sensitive to colour perception than a central traffic section of the road surface 34.

Because in particular a solid-state light source such as LED lighting is less heavy, and given the simple processing options which limit energy losses, a more advantageous installation and use of the lighting arrangement is possible, compared with lighting arrangements involving conventional street lighting such as sodium lamps. It is possible, for example, for the lighting units 1 to be mounted at lesser heights, for example between 0.5 and 4 m. The lesser height and the use of a lighting arrangement comprising a solid-state light source such as LED lighting results in a reduction of night-time light pollution.

In addition to a conventional post, a crash barrier or a noise barrier can serve as a supporting element. To prevent negative effects on the lighting unit 1 at a height corresponding thereto, the lighting unit can be provided with one or more additional protection elements. In FIGS. 4*a* and 4*b*, the lighting unit 1 is provided with a cover element 40 comprising a transparent opening which coincides with the transparent side of the lighting arrangement 1. By means of this cover element 40 it is possible to prevent excessive fouling of the lighting unit 1 by passing traffic. Preferably, as schematically shown in the cross section of FIG. 4*b*, both the transparent opening of the cover element 40 and the transparent side of the lighting unit 1 point in a direction which is at a slight angle to the direction of traffic. This direction of traffic is indicated in FIG. 4*a* by an arrow. The cover element 40 is attached, by means of a fastening means 41, to a supporting element 42, for example an upright of a crash barrier, as shown in FIGS. 4*a*, 4*b* and 5. An advantage of positioning the lighting units 1 at a low level is that more effective concentration of the light on the road surface can be achieved. The low-level position results, in particular, in greater vertical light intensity. This is further increased by the light being projected onto the road surface from the same direction as the vehicle driver, as a result of which a large portion of the reflections occurring on the road surface are reflected directly towards the driver of the vehicle.

The presence of the lighting units 1 at a relatively low height provides the additional option of employing the lighting units 1 for traffic signalling. Thus, a series of lighting units 1, mounted on a crash barrier, could serve as a warning running light against the direction of traffic, to indicate an imminent stoppage as a result of an accident or traffic jam.

Preferably, the lighting unit 1 is pointable, for example by making use, in conjunction with the supporting element 42, of a fastening means 41 comprising a universal joint 43, as depicted in the lighting arrangement shown in FIG. 5. By pointing the light it is possible to prevent blinding. Moreover, correct orientation allows a ratio, ideal for the environment in question, between horizontal and vertical light intensity to be achieved. A smaller angle between the light beam to be emitted and the road surface to be illuminated reduces horizontal light intensity, leading to reduced visibility of, for example, markings. On the other hand, the vertical light intensity is increased by such a change in angle, as a result of which objects such as stones on the road surface will be more readily visible.

The description hereinabove describes just a number of possible embodiments of the present invention. It can be readily seen that many alternative embodiments of the invention can be conceived which all fall within the scope of the invention. The present invention is defined by the following claims.

The invention claimed is:

1. Lighting arrangement for illuminating a surface comprising:

a supporting element;

a lighting unit which is supported by the supporting element;

wherein the lighting unit comprises a housing which is designed to accommodate a solid-state light source which, when in use, generates light having wavelengths from a first wavelength region and a second wavelength region, the housing being transparent on at least one side, wherein the wavelengths of the first wavelength region are shorter than the wavelengths of the second wavelength region, the first wavelength region has a wavelength range of between 500-550 nm, the wavelengths of the first wavelength region and the second wavelength region are separated by more than 20 nm, and the lighting unit generates light in the first wavelength region 3-5 times greater than the light of the second wavelength region.

2. Lighting arrangement according to claim 1, wherein the lighting arrangement illuminates the surface to be illuminated with a light intensity of 5-30 lux.

3. Lighting arrangement according to claim 1, wherein that the solid-state light source has a minimum output of 300 lumens.

4. Lighting arrangement according to claim 1, wherein the lighting unit further comprises a light processing unit for processing at least one of the intensity and the direction of light generated by the solid-state light source.

5. Lighting arrangement according to claim 1, wherein the solid-state light source comprises a plurality of Light Emitting Diodes.

6. Lighting arrangement according to claim 5, wherein the LEDs have a beam angle of 30-70°.

7. Lighting arrangement according to claim 5, wherein the LEDs are arranged in such a way that the light source in use emits light at an angle of at least 20° relative to the surface to be illuminated.

8. Lighting arrangement according to claim 7, wherein the angle relative to the surface to be illuminated does not exceed 30°.

9. Lighting arrangement according to claim 1, wherein the lighting unit further comprises a supply for connection to the solid-state light source and being designed to provide the solid-state light source with an electricity supply.

10. Lighting arrangement according to claim 1, wherein the first wavelength region comprises wavelengths of 500-530 nm and the second wavelength region comprises wavelengths of 560-590 nm.

11. Lighting arrangement according to claim 1, wherein the dominant wavelength in the first wavelength region is 507 nm.

12. Lighting arrangement according to claim 1, wherein the solid-state light source comprises a plurality of Light Emitting Diodes, wherein the plurality of LEDs comprises:

a number of first LEDs for emitting light having a wavelength situated in the first wavelength region; and a number of second LEDs for emitting light having a wavelength situated in the second wavelength region.

13. Lighting arrangement according to claim 12, wherein the lighting unit further comprises a further light processing unit which processes the light coming from the number of first LEDs and the light coming from the number of second LEDs in manners which differ from one another.

14. Lighting arrangement according to claim 1, characterized in that the lighting arrangement further comprises a cover element which has an orifice and is positioned in such a way around the lighting unit that the orifice coincides with the transparent side of the housing of the lighting unit.

15. Lighting arrangement according to claim 1, wherein the lighting unit comprises green LEDs and amber LEDs, the green LEDs generating light in the first wavelength region and the amber LEDs generating light in the second wavelength region.

16. Lighting arrangement according to claim 1, wherein the second wavelength region comprises wavelengths of 560-610 nm.

17. Solid-state light source which, when in use, generates light having wavelengths situated in a first wavelength region and wavelengths situated in a second wavelength region, wherein the first wavelength region comprises wavelengths of 500-550 nm, the second wavelength region comprises wavelengths of 560-610 nm, and the solid-state light source has a light yield in the first wavelength region that is 3-5 times greater than the light yield in the second wavelength region.

18. Solid-state light source according to claim 17, wherein the solid-state light source has a minimum light output of 300 lumens.

19. Solid-state light source according to claim 17 wherein the solid-state light source comprises a plurality of Light Emitting Diodes (LEDs), wherein the plurality of LEDs comprises:

a number of first LEDs for emitting light having a wavelength situated in the first wavelength region; and a number of second LEDs for emitting light having a wavelength situated in the second wavelength region.

20. Solid-state light source according to claim 18, wherein at least one of the plurality of LEDs have a beam angle of 30-70°.

* * * * *